US009174770B2

(12) United States Patent
Yourist et al.

(10) Patent No.: US 9,174,770 B2
(45) Date of Patent: Nov. 3, 2015

(54) CONTAINER WITH BEND RESISTANT GRIPPABLE DOME

(75) Inventors: Sheldon E. Yourist, York, PA (US); Travis A. Hunter, Hallam, PA (US); Raymond A. Pritchett, Jr., Brogue, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 390 days.

(21) Appl. No.: 12/784,658

(22) Filed: May 21, 2010

(65) Prior Publication Data

US 2011/0284493 A1 Nov. 24, 2011

(51) Int. Cl.
*B65D 23/10* (2006.01)
*B65D 1/02* (2006.01)

(52) U.S. Cl.
CPC ..... *B65D 23/102* (2013.01); *B65D 1/023* (2013.01); *B65D 1/0223* (2013.01); *B65D 23/106* (2013.01)

(58) Field of Classification Search
CPC ..... B65D 23/102; B65D 23/106; B65D 25/2897; B65D 25/2885; B65D 1/0223; B65D 1/02; B65D 1/023
USPC ..... 215/384, 382, 383; 220/675
See application file for complete search history.

(56) References Cited

U.S. PATENT DOCUMENTS

| | | | | | |
|---|---|---|---|---|---|
| 3,225,950 | A | * | 12/1965 | Josephsen et al. | 215/384 |
| 4,170,622 | A | | 10/1979 | Uhlig | |
| 5,637,167 | A | | 6/1997 | Krishnakumar et al. | |
| 6,161,713 | A | * | 12/2000 | Krich | 215/384 |
| D452,444 | S | * | 12/2001 | Iizuka et al. | D9/520 |
| D459,234 | S | * | 6/2002 | Bourque et al. | D9/543 |
| 6,398,052 | B1 | * | 6/2002 | Cheng et al. | 215/384 |
| 6,494,333 | B2 | | 12/2002 | Sasaki et al. | |
| 6,575,321 | B2 | * | 6/2003 | Bourque et al. | 215/384 |
| 6,974,047 | B2 | | 12/2005 | Kelley et al. | |
| 7,004,342 | B2 | * | 2/2006 | Bourque et al. | 215/384 |
| D527,272 | S | * | 8/2006 | Lovelace et al. | D9/541 |
| D530,212 | S | * | 10/2006 | Darr et al. | D9/543 |
| 7,350,658 | B2 | * | 4/2008 | Bourque et al. | 215/384 |
| 7,455,189 | B2 | * | 11/2008 | Lane et al. | 215/381 |
| 2005/0045645 | A1 | | 3/2005 | Tsutsui et al. | |
| 2005/0092708 | A1 | | 5/2005 | Heisner et al. | |
| 2005/0211660 | A1 | | 9/2005 | Galownia et al. | |
| 2006/0175284 | A1 | * | 8/2006 | Noll et al. | 215/382 |
| 2007/0170144 | A1 | | 7/2007 | Lane et al. | |
| 2007/0187354 | A1 | | 8/2007 | Sasaki | |
| 2009/0266786 | A1 | | 10/2009 | Sasaki | |
| 2010/0006535 | A1 | | 1/2010 | Ogg | |

FOREIGN PATENT DOCUMENTS

| | | |
|---|---|---|
| JP | 7-076333 | 3/1995 |

OTHER PUBLICATIONS

International Search Report dated Jul. 4, 2011 for corresponding PCT/US2011/036963 filed May 18, 2011.

* cited by examiner

*Primary Examiner* — Stephen Castellano
(74) *Attorney, Agent, or Firm* — Baker Botts L.L.P.

(57) ABSTRACT

A plastic container having improved structural stability characteristics when gripped includes a finish and a main body having a sidewall. The main body has a lower portion and an upper dome that is separated from the lower portion by a waist. The upper dome includes an upper brow portion having a first maximum width and that has a concave recess defined therein. A gripping recess may be defined in the sidewall beneath the upper brow portion, which has a second minimum width that is less than the first maximum width. A portion of the sidewall that defines the gripping recess may have a substantially vertically oriented reinforcing element defined therein. In addition, a portion of the sidewall that defines the gripping recess may have U-shaped groove defined therein.

15 Claims, 7 Drawing Sheets

CONTAINER WITH BEND RESISTANT GRIPPABLE DOME

BACKGROUND OF THE INVENTION

1. Field of the Invention

This invention relates to blow molded plastic containers, and particularly those containers having an upper dome or bell portion that is designed to be gripped by a consumer during use.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

The use of blow molded plastic containers for the purpose of packaging liquids that are processed by the hot fill and/or pasteurization processes has been known for some time. The hot fill process involves filling the containers while the liquid product is at an elevated temperature, typically 68° C. to 96° C. (155° F.-205° F.) and usually about 85° C. (185° F.) in order to sterilize the container at the time of filling. Containers that are designed to withstand the hot fill process are known as "hot fill" or "heat set" containers. Such containers are typically designed with sidewalls that include one or more recessed vacuum panels that are designed to flex due to the temperature changes and consequent volumetric expansion and contraction that takes place during processing. In many instances, the recessed vacuum panels also provide convenient handholds that facilitate gripping of the container by consumers.

One type of conventional container design includes a lower portion and an upper dome or bell portion that is separated from the lower portion by a waist. In the past, it has been found to be difficult as a matter of design to provide effective gripping recesses within a dome or bell portion while maintaining material costs at an economically acceptable level, because the force created by a consumer while gripping the container has the tendency to collapse portions of the dome or bell portion. A need exists for an improved plastic container having an upper dome or bell portion that is designed to be gripped by a consumer during use, which provides improved optimization of structural stability and material costs with respect to conventional designs.

SUMMARY OF THE INVENTION

Accordingly, it is an object of the invention to provide an improved plastic container having an upper dome or bell portion that is designed to be gripped by a consumer during use, which provides improved optimization of structural stability and material costs with respect to conventional designs.

In order to achieve the above and other objects of the invention, a plastic container according to a first aspect of the invention includes a finish and a main body having a sidewall.

The main body has a lower portion and an upper dome that is separated from the lower portion by a waist. The upper dome includes an upper brow portion having a first maximum width, and the upper brow portion has a concave recess defined therein. A gripping recess is defined in the sidewall beneath the upper brow portion and has a second minimum width that is less than the first maximum width. A portion of the sidewall that defines the gripping recess also has a U-shaped groove defined therein.

A plastic container according to a second aspect of the invention includes a finish; and a main body having a sidewall. The main body has a lower portion and an upper dome that is separated from the lower portion by a waist. The upper dome includes an upper brow portion having a first maximum width, and the upper brow portion has a concave recess defined therein. A gripping recess is defined in the sidewall beneath the upper brow portion and has a second minimum width that is less than the first maximum width. A portion of the sidewall that defines the gripping recess also has a substantially vertically oriented reinforcing element defined therein.

A plastic container according to a third aspect of the invention includes a finish; and a main body having a sidewall. The main body has a lower portion and an upper dome that is separated from the lower portion by a waist. The upper dome includes an upper brow portion having a first maximum width. A gripping recess is defined in the sidewall beneath the upper brow portion and has a second minimum width that is less than the first maximum width. A portion of the sidewall that defines the gripping recess also has a U-shaped groove defined therein and a substantially vertically oriented reinforcing element defined therein.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
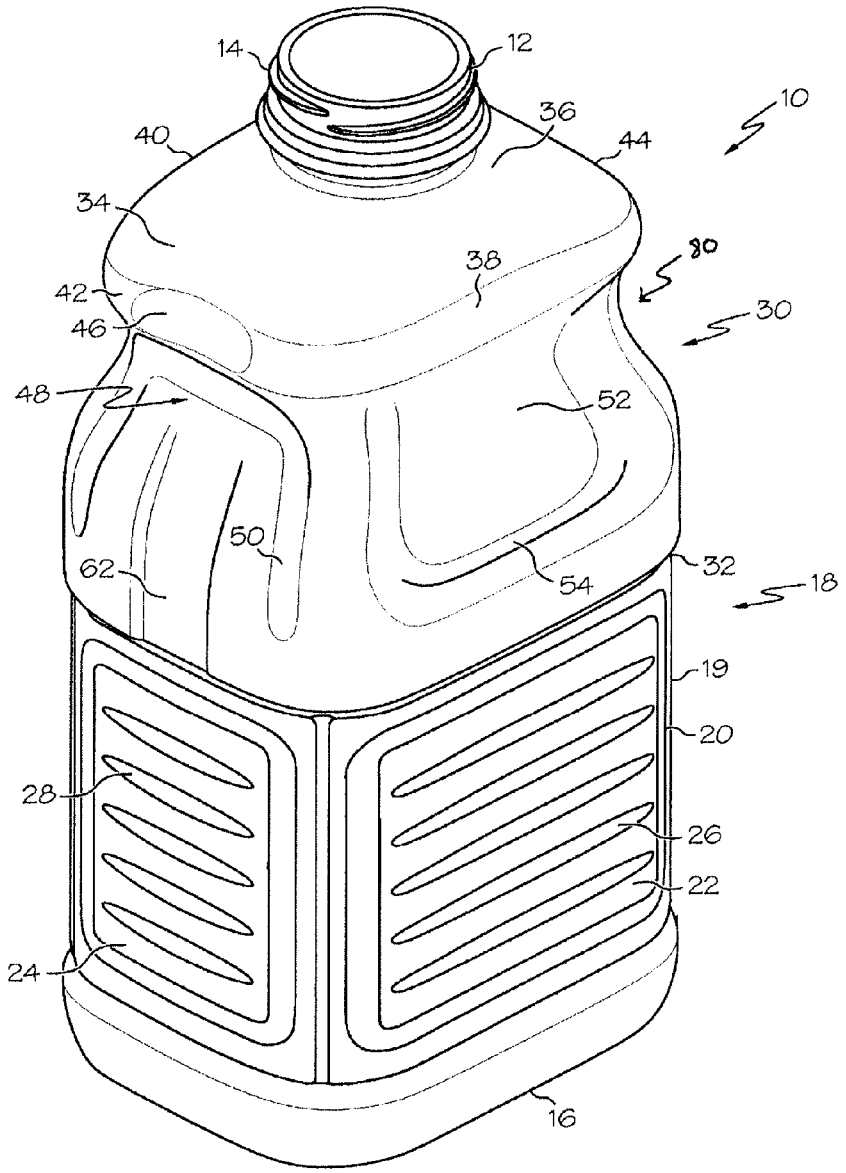
FIG. 1 is a perspective view of a plastic container that is constructed according to a preferred embodiment of the invention.

Referring now to the drawings, wherein like reference numerals designate corresponding structure throughout the views, and referring in particular to FIG. 1, a plastic container 10 that is constructed according to a preferred embodiment of the invention is preferably fabricated from a material such as polyethylene terephthalate (PET) from a preform using a conventional reheat stretch blow molding process. Plastic container 10 is preferably, although not necessarily, constructed for hot fill applications.

In the preferred embodiment that is shown in FIG. 1, plastic container 10 includes a threaded finish 12 having one or more threads 14 defined thereon, to which a conventional closure cap or dispensing cap may be secured. Plastic container 10 further preferably includes a bottom portion 16 and a main body portion 18 having a thin plastic sidewall 19 that is unitary with the finish 12 and the bottom portion 16.

As FIG. 1 shows, the main body portion 18 includes a lower portion 20 that is preferably substantially rectangular in horizontal cross-section. Lower portion 20 preferably includes front and rear panels 22 and side panels 24 that are narrower than the front and rear panels 22. In the preferred embodiment, a plurality of horizontally oriented reinforcement grooves or inwardly extending ribs 26 are defined in the front and back panels 22. Similar horizontally oriented reinforcement grooves or inwardly extending ribs 28 are also preferably defined in the side panels 24. The presence of the inwardly extending grooves or ribs 26, 28 enhances the structural stability of the lower portion 20, especially during the vacuum uptake phase of the hot fill process.

The main body portion 18 also preferably includes an upper dome or bell 30 that is separated from the lower portion 20 by a waist 32. In the illustrated embodiment, the waist 32 is embodied as a peripheral inwardly extending groove, but an alternative embodiments it may be more or less pronounced or it may simply be an interface between the upper dome 30 and the lower portion 20.

Figure 4:
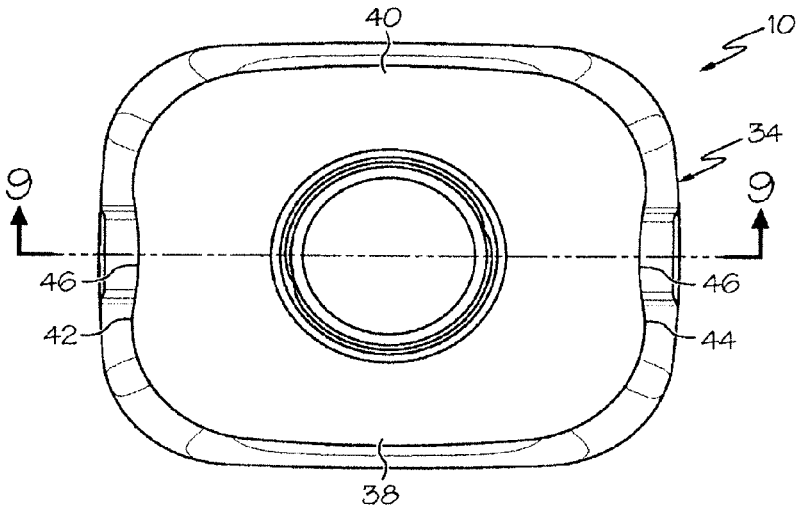
FIG. 4 is a top plan view of the container that is shown in FIG. 1.
Figure 5:
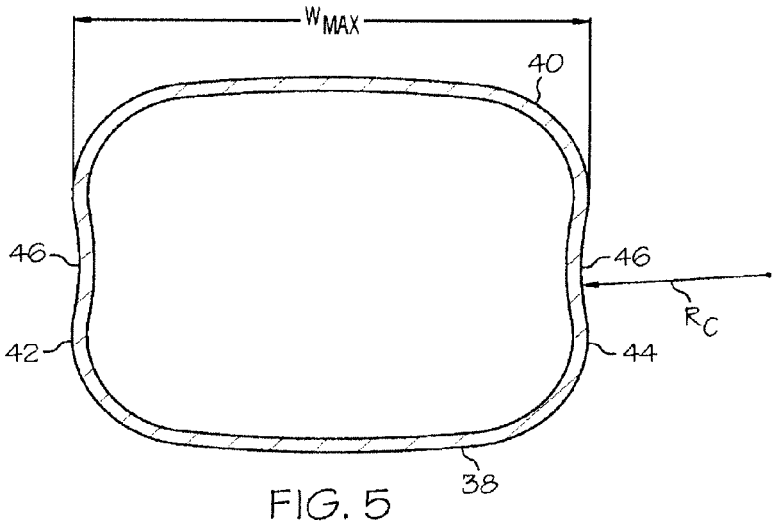
FIG. 5 is a cross-sectional view taken along lines 5-5 in FIG. 2.
Figure 6:
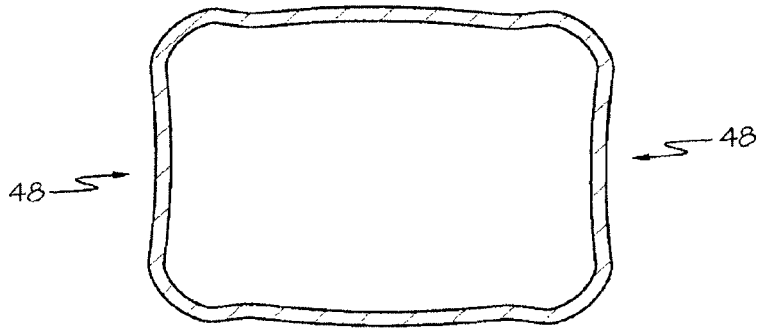
FIG. 6 is a cross-sectional view taken along lines 6-6 in FIG. 2.
Figure 7:
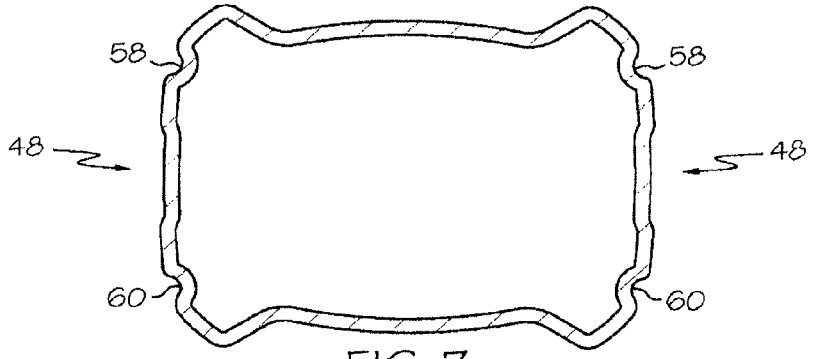
FIG. 7 is a cross-sectional view taken along lines 7-7 in FIG. 2.

The upper dome 30 preferably includes an upper brow portion 34 that is shaped so as to substantially approximate a rounded rectangle when viewed in top plan, as is shown in FIG. 4. In the preferred embodiment, the upper brow portion 34 has a generally bulbous shape and includes a rounded upper surface 36 that forms an upper shoulder of the container 10 and is integral with the finish 12. The upper brow portion 34 further includes a first pair of sides, namely front and rear sides 38, 40 that have a first width, and a second, lateral pair of sides 42, 44 having a second width that is less than the first width. The upper brow portion 34 has a first maximum width $W_{MAX}$, as is best shown in FIG. 5.

In the preferred embodiment, a concave recess 46 is defined in each of the lateral sides 42, 44 of the upper brow portion 34. Alternatively, the concave recess 46 may be defined in only one of the lateral sides 42, 44. Preferably, each concave recess 46 is substantially centered vertically and horizontally with respect to the lateral side 42, 44 in which it is defined. Each of the concave recesses 46 preferably intersects a horizontal plane that also intersects portions of the upper brow portion 34 that define the first maximum width $W_{MAX}$. The presence of the concave recesses 46 provides significant additional structural stability to the upper brow portion 34 when the container 10 is gripped by a consumer during use. Preferably, both of the concave recesses 46 have a radius of curvature $R_C$, and a ratio of $R_C/W_{MAX}$ is preferably within a range of about 0.95 to about 0.99.

Directly beneath the lateral sides 42, 44 of the upper brow portion 34 are defined first gripping recesses 48 for facilitating gripping of the container 10 by a consumer. In the preferred embodiment, the structural stability of each of the gripping recesses 48 is enhanced by the presence of an inverted U-shaped groove 50, as may best be seen in FIGS. 1 and 3. The inverted U-shaped groove 50 includes a substantially horizontal upper portion 56 and first and second downwardly extending leg portions 58, 60. The substantially horizontal upper portion 56 is preferably directly beneath the lateral side 42, 44 of the upper brow portion 34 and therefore directly beneath the concave recess 46. The juxtaposition of the concave recess 46 and the horizontal upper portion 56 of the U-shaped groove 50 creates a sharp undercut and a tightly radiused transition portion that both enhances grippability of the container 10 and provides significant reinforcement against deformation when the container 10 is gripped by a consumer, without requiring significant additional material during the fabrication process.

Figure 2:
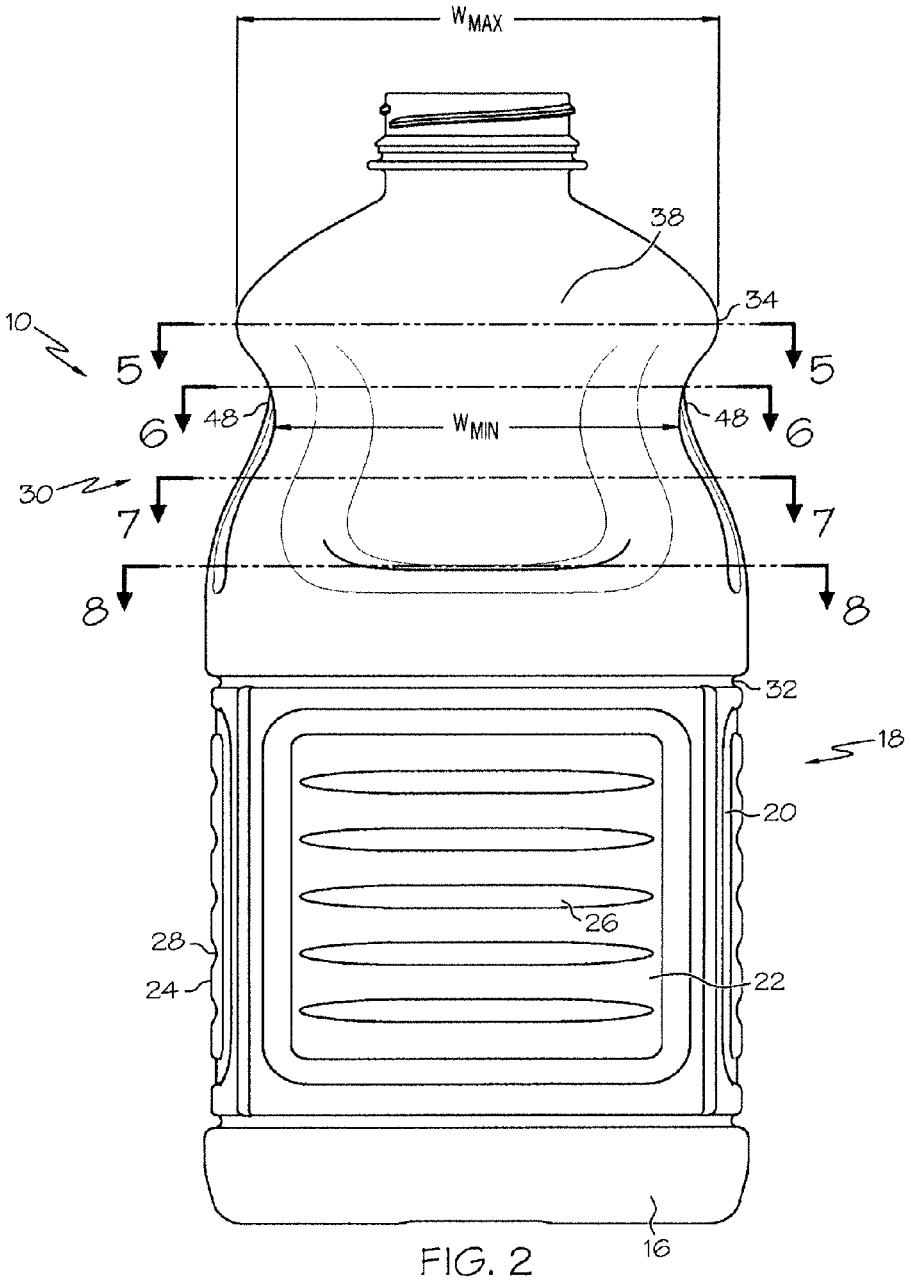
FIG. 2 is a front elevational view of the container that is shown in FIG. 1.

The upper dome 30 also preferably includes second gripping recesses 52 that are defined directly beneath the front and rear sides 38, 40 of the upper brow portion 34. The portions of the sidewall 19 defining the second gripping recesses 52 each have a U-shaped groove 54 defined therein for providing additional structural stability when the container 10 is gripped by a consumer. In the preferred embodiment, the uppermost and lowermost extents of the U-shaped groove 54 are both substantially the same as that of the U-shaped groove 50 that is defined in the portion of the sidewall 19 that defines the first gripping recesses 48. The U-shaped groove 54 is also preferably substantially centered with respect to both the second gripping recess 52 and the front or rear side 38, 40 of the upper brow portion 34 that is positioned directly above it. As embodied herein, and as illustrated in FIG. 1, the first gripping recesses 48 and second gripping recess 52 can collectively define an annular gripping recess 80 extending along the front and rear sides 38, 40 and opposing first and second lateral sides 42, 44 between the upper brow 34 and the annular groove 32. The gripping recess 80 can have an arcuate concave exterior profile in side view, as shown in FIGS. 2 and 3.

Figure 8:
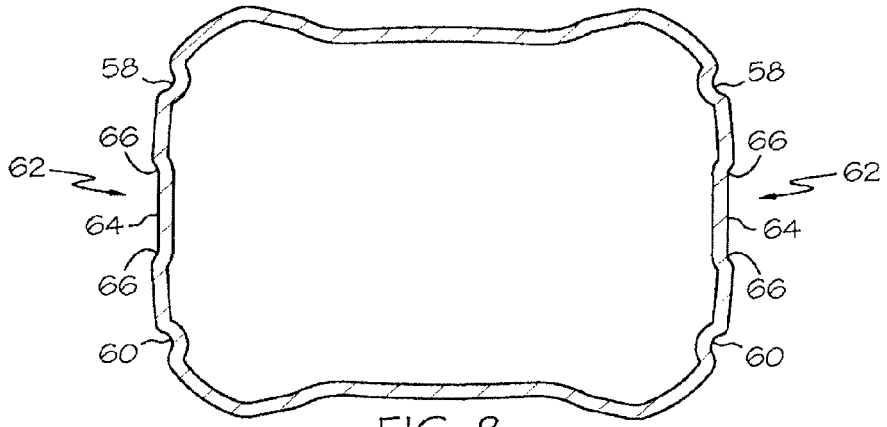
FIG. 8 is a cross-sectional view taken along lines 8-8 in FIG. 2.
Figure 9:
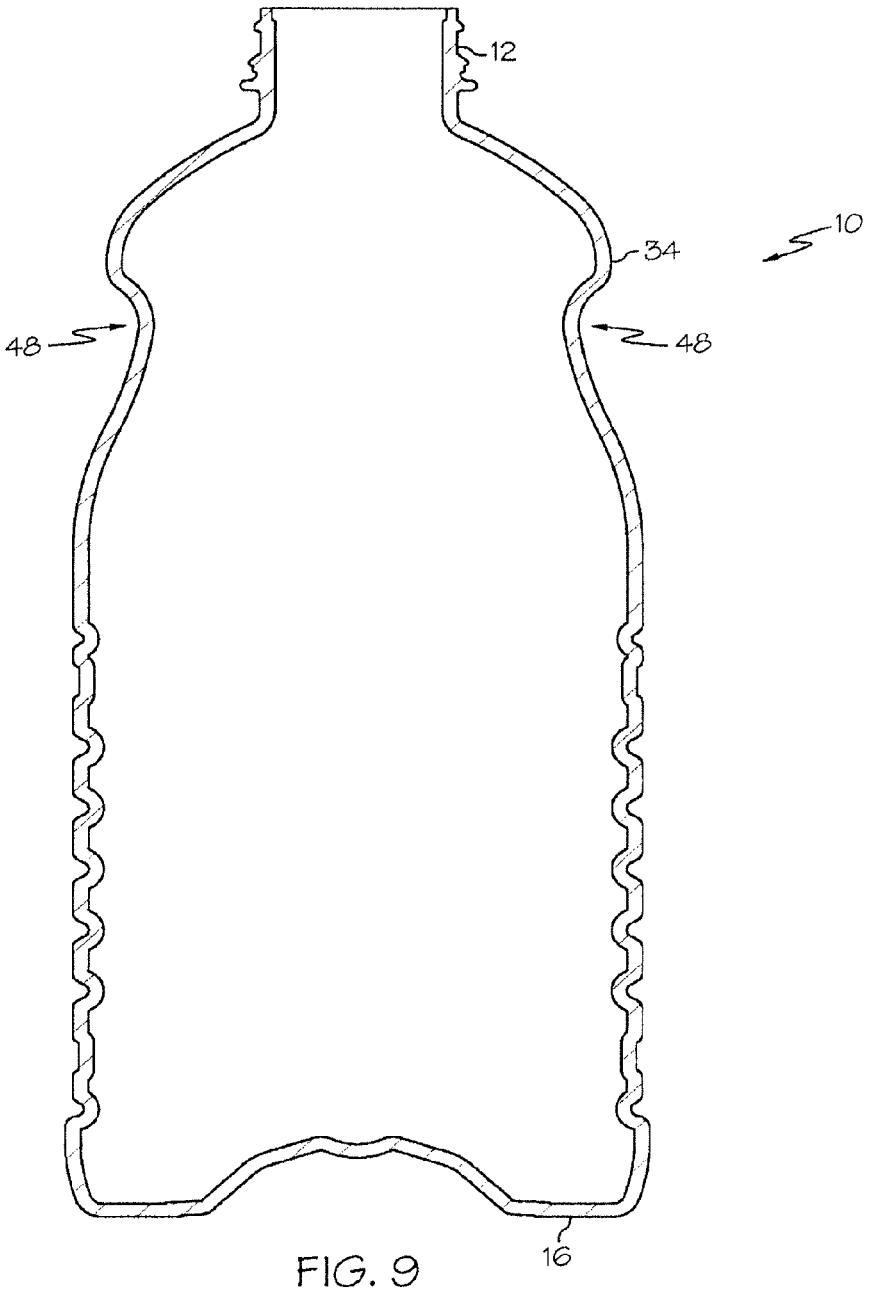
FIG. 9 is a cross-sectional view taken along lines 9-9 in FIG. 4.

The portion of the sidewall 19 that defines each of the first gripping recesses 48 is also preferably provided with a vertically oriented reinforcing element 62 that is separate from the inverted U-shaped groove 50. In the preferred embodiment, the vertically oriented reinforcing element 62 includes a vertically oriented recessed band or groove having a substantially flat bottom surface 64 and a pair of edge portions 66 connecting the substantially flat bottom surface 64 to the rest of the sidewall 19 that defines the first gripping recesses 48, as is shown in cross-section in FIG. 8.

The presence of the vertically oriented reinforcing element 62 provides significant additional structural reinforcement against deformation of the portion of the sidewall 19 that defines the first gripping recesses 48, acting in conjunction with the structural reinforcement that is provided by the U-shaped groove 50 and by the presence of the concave recess 46.

Figure 3:
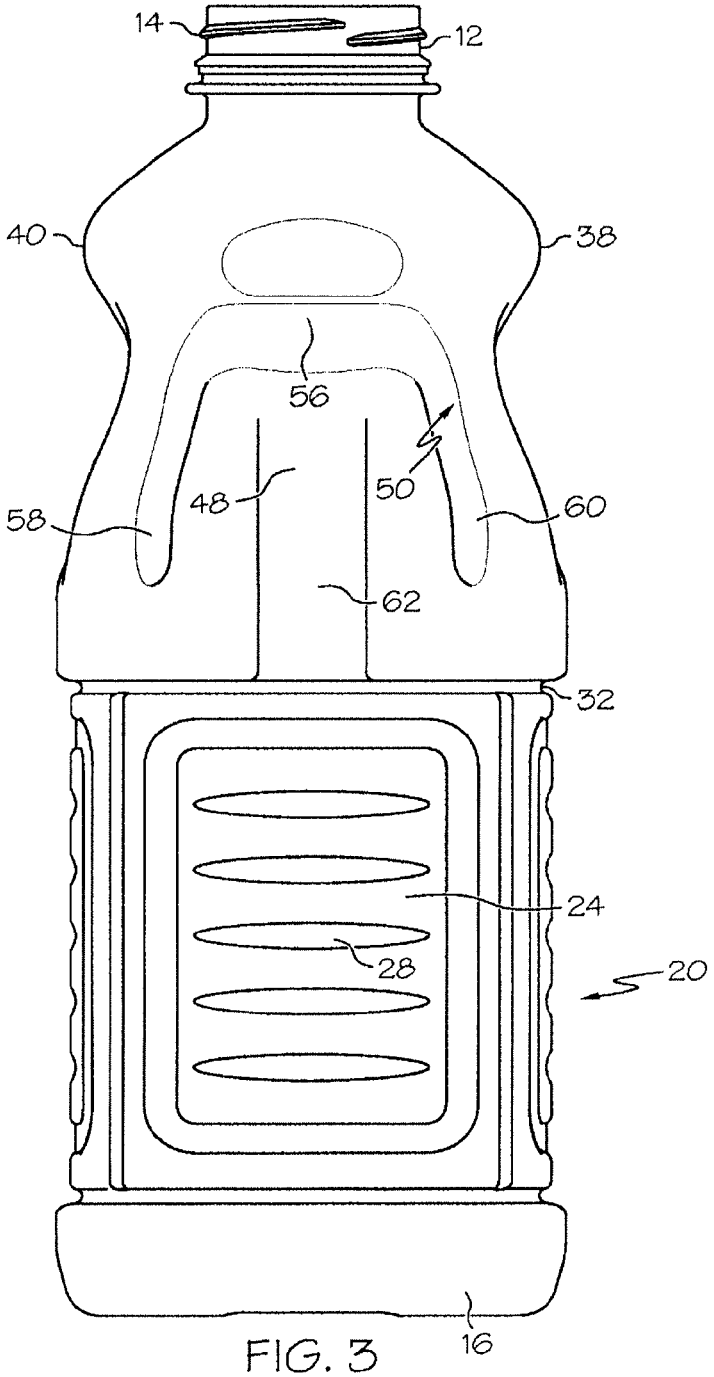
FIG. 3 is a side elevational view of the container that is shown in FIG. 1.
Figure 10:
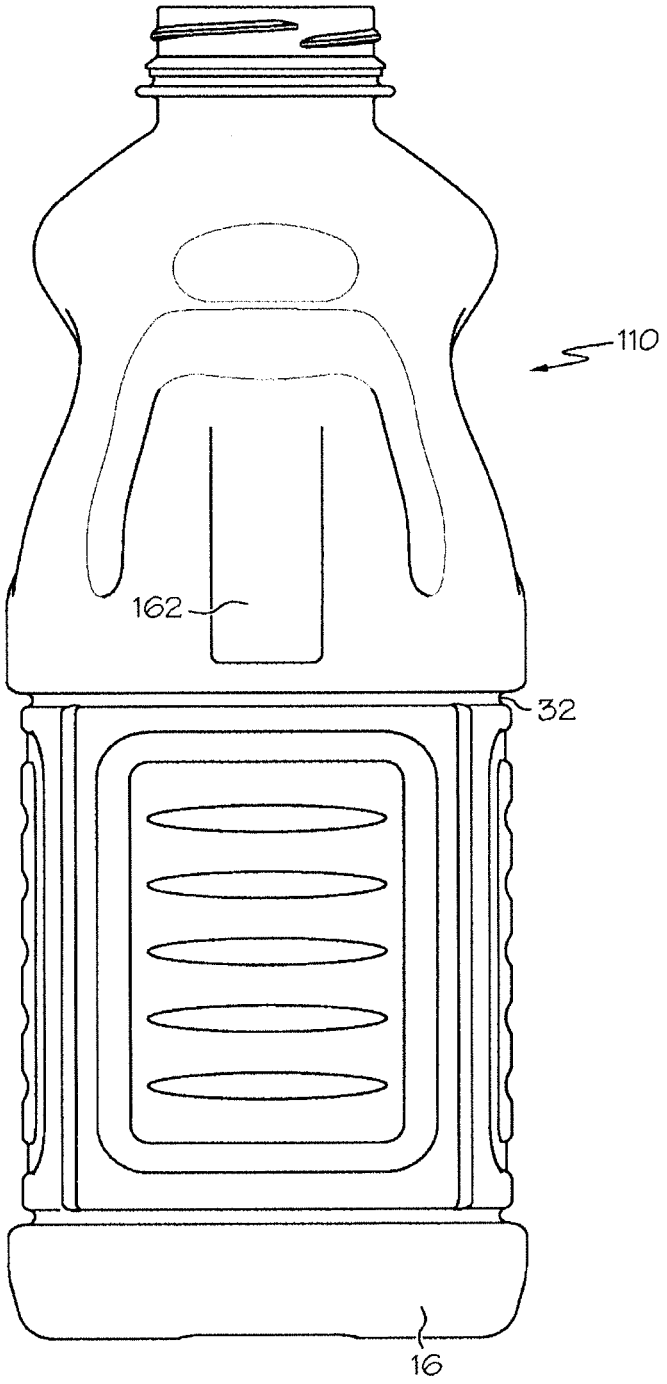
FIG. 10 is a side elevational view of a container that is constructed according to an alternative embodiment.

In the embodiment shown in FIG. 3, the vertically oriented reinforcing element 62 is constructed to extend to the bottom of the upper dome or bell 30 and to the waist 32. However, in an alternative embodiment of the invention that is shown in FIG. 10, a container 110 is constructed so that the bottom of the vertically oriented reinforcing element 162 is above the bottom of the upper dome or bell 30 and the waist 32.

In the preferred embodiment, the vertically oriented reinforcing element 62 extends substantially all the way to the bottom of the upper dome 30 to the waist 32. The vertically oriented reinforcing element is also preferably substantially centered when viewed in side elevation with respect to the downwardly extending legs 58, 60 of the U-shaped groove 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a main body portion and a dome portion spaced from the main body portion by an annular groove extending entirely around a perimeter of the container in plan view;

wherein the dome portion is generally rectangular in plan view and comprises:

opposing front and rear sides and opposing first and second lateral sides;

an upper brow portion having a maximum brow width between the opposing first and second lateral sides;

an annular gripping recess defined along the front and rear sides and opposing first and second lateral sides between the upper brow and the annular groove, the gripping recess having an arcuate concave exterior profile in side view with a gripping recess minimum width defined between the opposing first and second lateral sides, the gripping recess minimum width being less than the brow maximum width; and a first U-shaped groove defined on at least one of the opposing first and second lateral sides, the first U-shaped groove having an inverted U-shape path in side view, and a second U-shaped groove defined on at least one of the front and rear sides, the second U-shaped groove having a non-inverted U-shape path in side view.

2. The plastic container of claim 1, wherein the upper brow portion further comprises a concave recess defined therein.

3. The plastic container of claim 2, wherein the concave recess is defined on at least one of the first and second lateral side.

4. The plastic container of claim 2, wherein the concave recess is defined in at least one of the first and second lateral side, and wherein the first U-shaped groove is defined in a portion of the dome between the upper brow and the annular groove.

5. The plastic container of claim 1, further comprising a substantially vertically oriented reinforcing element defined on the gripping recess.

6. The plastic container of claim 1, comprising a U-shaped groove having a non-inverted U-shape path in side view disposed on each of the front and rear side of the dome.

7. The plastic container of claim 6, comprising a U-shaped groove having an inverted U-shape path in side view disposed on each of the opposing first and second lateral side of the dome.

8. The plastic container of claim 1, wherein the main body is generally rectangular in plan view.

9. A plastic container, comprising:

a main body portion and a dome portion spaced from the main body portion by an annular groove extending entirely around a perimeter of the container in plan view;

wherein the dome portion is generally rectangular in plan view and comprises:

opposing front and rear sides and opposing first and second lateral sides;

an upper brow portion having a maximum brow width between the opposing first and second lateral sides;

an annular gripping recess defined along the front and rear sides and opposing first and second lateral sides between the upper brow and the annular groove, the gripping recess having an arcuate concave exterior profile in side view with a gripping recess minimum width defined between the opposing first and second lateral sides, the gripping recess minimum width being less than the brow maximum width;

a first U-shaped groove defined on at least one of the opposing first and second lateral sides, the first U-shaped groove having an inverted U-shape path in side view, and a second U-shaped groove defined on at least one of the front and rear sides, the second U-shaped groove having a U-shape path in side view; and wherein each of the first and second U-shaped grooves is disposed directly beneath the upper brow portion.

10. The plastic container of claim 9, wherein the upper brow portion further comprises a concave recess defined therein.

11. The plastic container of claim 10, wherein the concave recess is defined on at least one of the first and second lateral side.

12. The plastic container of claim 10, wherein the concave recess is defined in at least one of the first and second lateral side, and wherein the first U-shaped groove is defined in a portion of the dome between the upper brow and the annular groove.

13. The plastic container of claim 9, further comprising a substantially vertically oriented reinforcing element defined on the gripping recess.

14. The plastic container of claim 9, comprising a U-shaped groove having a non-inverted U-shape path in side view disposed on each of the front and rear side of the dome.

15. The plastic container of claim 14, comprising a U-shaped groove having an inverted U-shape path in side view disposed on each of the opposing first and second lateral side of the dome.

* * * * *